US007431220B2

(12) United States Patent
Kanne et al.

(10) Patent No.: US 7,431,220 B2
(45) Date of Patent: Oct. 7, 2008

(54) INJECTOR FOR FUEL INJECTION SYSTEMS OF INTERNAL COMBUSTION ENGINES, ESPECIALLY DIRECT-INJECTION DIESEL ENGINES

(75) Inventors: Sebastian Kanne, Schwaikheim (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/559,710

(22) PCT Filed: Apr. 8, 2004

(86) PCT No.: PCT/DE2004/000738

§ 371 (c)(1),
(2), (4) Date: Dec. 7, 2005

(87) PCT Pub. No.: WO2004/111434

PCT Pub. Date: Dec. 23, 2004

(65) Prior Publication Data

US 2006/0255184 A1 Nov. 16, 2006

(30) Foreign Application Priority Data

Jun. 11, 2003 (DE) ..... 103 26 259

(51) Int. Cl.
*B05B 1/08* (2006.01)

(52) U.S. Cl. ..... 239/102.2; 239/533.3; 239/533.7; 239/102.1; 239/533.2; 123/496; 123/498

(58) Field of Classification Search ..... 239/88, 239/89, 90, 91, 92, 93, 94, 95, 96, 102.1, 239/102.2, 533.1, 533.2, 533.3, 533.5, 533.6, 239/533.8, 533.9, 533.11, 533.12, 585.1, 239/585.4, 585.5; 251/129.06; 123/466, 123/498; 310/326, 327
See application file for complete search history.

(56) References Cited

U.S. PATENT DOCUMENTS 4,022,166 A * 5/1977 Bart ..... 239/584

(Continued)

FOREIGN PATENT DOCUMENTS

DE 35 18 945 A1 11/1986

(Continued)

*Primary Examiner*—Len Tran
*Assistant Examiner*—Trevor E. McGraw
(74) *Attorney, Agent, or Firm*—Ronald E. Greigg

(57) ABSTRACT

A fuel injector having a piezoelectric actuator in an injector body and held in contact with the injector body on one side and with a sleevelike booster piston on the other via first spring means. A nozzle body joined to the injector body and a stepped nozzle needle is guided in the body. A second spring disposed inside the booster piston which together with the injection pressure acting on the back side of the nozzle needle keeps the nozzle needle in the closing position. A control chamber on the end toward the nozzle needle of the booster piston communicates, via at least one leakage gap with a fuel supply at injection pressure, and the nozzle needle is urged in the opening direction by the fuel located in the control chamber. The booster piston actuated by the piezoelectric actuator is spatially associated directly with the nozzle needle so that the nozzle needle is fitted, with a rear region that has a larger diameter than a region of the nozzle needle toward the nozzle outlet, into the inner chamber of the booster piston.

12 Claims, 2 Drawing Sheets

U.S. PATENT DOCUMENTS

| | | | | |
|---|---|---|---|---|
| 4,437,644 | A * | 3/1984 | Wilmers | 251/11 |
| 5,482,213 | A | 1/1996 | Matsusaka et al. | |
| 5,947,380 | A * | 9/1999 | Coldren et al. | 239/88 |
| 6,502,803 | B1 * | 1/2003 | Mattes | 251/129.06 |
| 6,766,965 | B2 * | 7/2004 | D'Arrigo | 239/102.2 |
| 2002/0050535 | A1 * | 5/2002 | Igashira et al. | 239/533.2 |
| 2002/0053611 | A1 * | 5/2002 | Boecking | 239/533.2 |
| 2006/0169802 | A1 * | 8/2006 | Pauer | 239/533.2 |
| 2006/0208107 | A1 * | 9/2006 | Heinz | 239/533.2 |

FOREIGN PATENT DOCUMENTS

| | | | |
|---|---|---|---|
| DE | 43 06 073 | C1 | 6/1994 |
| DE | 101 51 688 | A1 | 4/2003 |
| EP | 1 174 615 | A2 | 1/2002 |
| JP | 61-272464 | | 2/1986 |
| JP | 8-506883 | | 7/1996 |
| JP | 10-288117 | | 10/1998 |
| JP | 11-200981 | | 7/1999 |
| JP | 2000-161175 | | 6/2000 |
| WO | WO 2004/111433 | * | 12/2004 |

* cited by examiner

INJECTOR FOR FUEL INJECTION SYSTEMS OF INTERNAL COMBUSTION ENGINES, ESPECIALLY DIRECT-INJECTION DIESEL ENGINES

CROSS-REFERENCE TO RELATED APPLICATIONS

This application is a 35 USC 371 application of PCT/DE 2004/000738 filed on Apr. 8, 2004.

BACKGROUND OF THE INVENTION

1. Field of the Invention

The invention relates to an improved fuel injector for injecting fuel into an internal combustion engine.

2. Description of the Prior Art

An injector of the generic type with which this invention is concerned has been disclosed by German Patent DE 195 19 191 C2. In the subject of that patent, the piezoelectric actuator and booster piston are seated on the upper end of the injector body, and the force transmission to the nozzle needle, located on the lower end of the injector body, is effected via a long tappet. The tappet is in hydraulic communication with the fuel inflow. A pressure conduit machined into the injector body leads to the nozzle outlet. An annular chamber surrounding the tappet in its lower region is also provided, at which a fuel return conduit originates. The fuel return conduit communicates hydraulically with an inner chamber, extending above the tappet, of the booster piston. A control chamber embodied below the booster piston is supplied from the fuel inflow via a leakage gap surrounding the tappet in the injector body.

The known injector is complicated in its construction, is composed of a comparatively large number of components, does not meet the stringent demands made of modem fuel injection systems, in particular common rail systems for diesel engines.

SUMMARY AND ADVANTAGES OF THE INVENTION

With the prior art described above as the point of departure, it is the object of the present invention to provide an injector suitable for common rail systems, that is comparatively simple in construction, that makes do with a minimum number of individual parts, and that operates efficiently.

Advantageous features of the fundamental concept of the invention are disclosed. A substantial advantage of the invention resides in the direct control of the nozzle needle by the piezoelectric actuator. The speed of the nozzle needle motion can be adjusted via the course of voltage of the piezoelectric actuator. For metering especially small preinjection quantities, a partial stroke may also be predetermined. A further advantage, particularly over the known injector of DE 195 19 191 C2 is that the injector of the invention makes do without a fuel return.

BRIEF DESCRIPTION OF THE DRAWINGS

The invention is more fully described herein below, with reference to the drawings, in which.

DESCRIPTION OF THE PREFERRED EMBODIMENT

Figure 1:
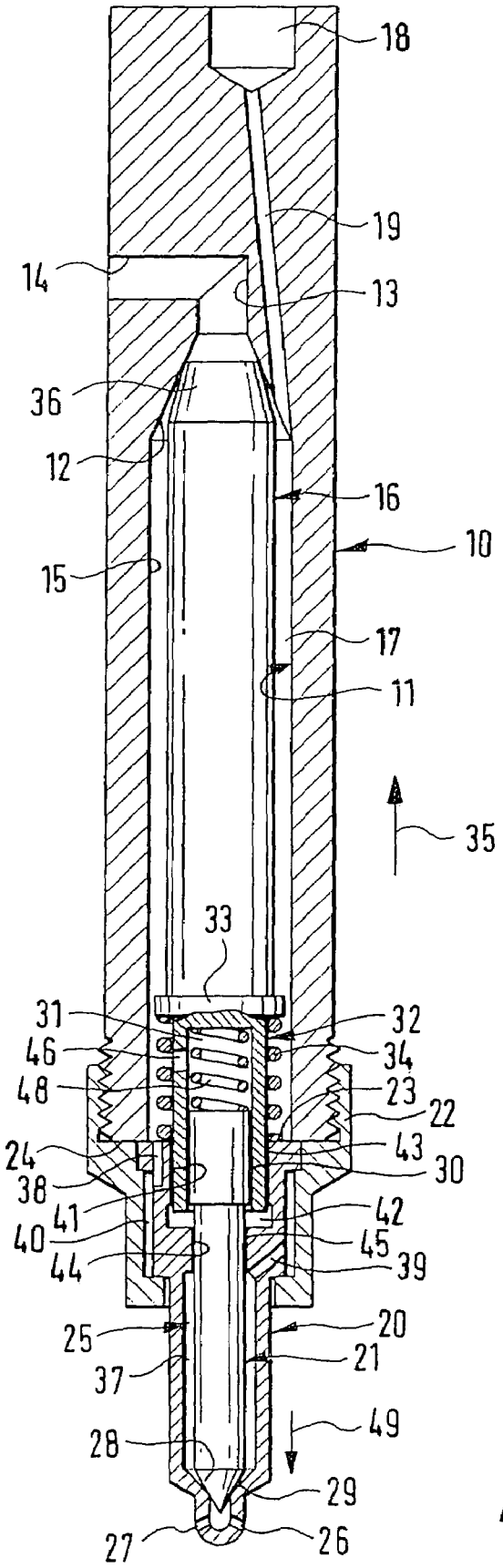
FIG. 1 is a sectional view schematically showing a direct-controlled common rail injector with a piezoelectric actuator and FIG. 2 is an enlarged view of the lower position of the injector of FIG. 1.

Reference numeral 10 designates a cylindrical injector body, with a continuous cylindrical recess 11 extending over the majority of the length of the injector body. On its upper end, the recess 11 has first a conically narrowing portion 12, which changes over to a right-angled conduit portion 13, 14 and finally discharges to the outside. Located in the cylindrical portion 15 of the recess 11 is a likewise cylindrical piezoelectric actuator 16 of comparatively great length, whose diameter is less than the inside diameter of the recess portion 15. This creates an annular chamber 17 between the outer wall of the piezoelectric actuator 16 and the inner wall of the injector body 10. For the requisite centering of the piezoelectric actuator 16 inside the injector body 10, the conical portion 12 of the axial recess 11 is used, for one thing. For another, as needed, fluid-passable shims (not shown) may be provided in the annular chamber 17, at defined axial spacings from one another.

The upper, angled portion 13, 14 of the recess 11 functions as a cable leadthrough for the supply of current to the piezoelectric actuator 16.

On the upper end of the injector body 10, a fuel supply 18 is provided, such as a high-pressure connection of a common rail system, and it is in hydraulic communication with the annular chamber 17 via a pressure conduit 19.

The lower end of the injector body 10 is adjoined coaxially by a nozzle body 20, which receives a nozzle needle 21. The nozzle body 20 is secured to the injector body 10 by means of a union nut (clamping nut) 22, in such a way that it comes sealingly to rest, with a rear end face 23, on a lower end face 24 of the injector body 10.

For receiving the nozzle needle 21, the nozzle body 20 has an inner chamber 25 that is open toward the top and is stepped several times and toward the bottom forms a conical valve seat 28 that discharges into two nozzle outlet bores 26, 27. The valve seat 28 cooperates with a conical end portion 29 of the nozzle needle 21, which end portion functions as a closing body.

On its upper end, the nozzle needle 21 has a portion 30 of larger diameter, which is fitted into a cylindrical inner chamber 31 of a sleevelike booster piston 32 open at the bottom. The upper closure of the booster piston 32 is formed by a collar 33. A helical compression spring 34, braced on one end on the end face 23 of the nozzle body 20 and on the other on the collar 33 of the booster piston 32, is located in the annular chamber 17—surrounding the booster piston 32—and keeps the booster piston 32 in contact by its face end with the piezoelectric actuator 16. By means of the pressure exerted by the compression spring 34 on the piezoelectric actuator 16 in the direction of the arrow 35 via the booster piston 32, the piezoelectric actuator 16 is sealed off on its top 36 from the injector body 10, and the electrical connection (not shown) can thus be extended to the outside from the injector body 10 through the angled bores 13, 14.

As the drawing also shows, in the lower part of the nozzle body 20—as a component of the nozzle body inner chamber 25—a cylindrical pressure chamber 37 is embodied, which concentrically surrounds the nozzle needle 21 and communicates hydraulically with the annular chamber 17 of the injector body 10, via bores 38, 39 in the nozzle body 20 and via an annular chamber 40 embodied between the nozzle body 20 and the clamping nut 22.

A further special feature is that the inner chamber 25 of the nozzle body 20 has a stepped increased diameter 41 at the top, in which the booster piston 32 is guided in such a way that a control chamber 42, embodied in the widened inner chamber portion 41 below the booster piston 32, is in hydraulic communication, via a leakage gap 43 (see in particular FIG. 2), with the annular chamber 17 of the injector body 10. A portion 44 of comparatively small diameter of the nozzle body inner chamber 25 serves to guide the nozzle needle 21 inside the nozzle body 20. This guide fit 44 is also conceived such that a leakage gap 45 (see in particular FIG. 2) is created. The control chamber 42 thus communicates hydraulically via the second leakage gap 45 with the cylindrical chamber 37, which in turn is subjected to high pressure, via the recesses 38, 39 and chamber 40 from the annular chamber 17 of the injector body 10.

Another special feature is that the inner chamber 31, extending above the nozzle needle 21, of the booster piston 32 likewise communicates hydraulically with the annular chamber 17, subjected to high pressure, of the injector body 10, specifically via a lateral bore 46 in the booster piston 32.

Figure 2:
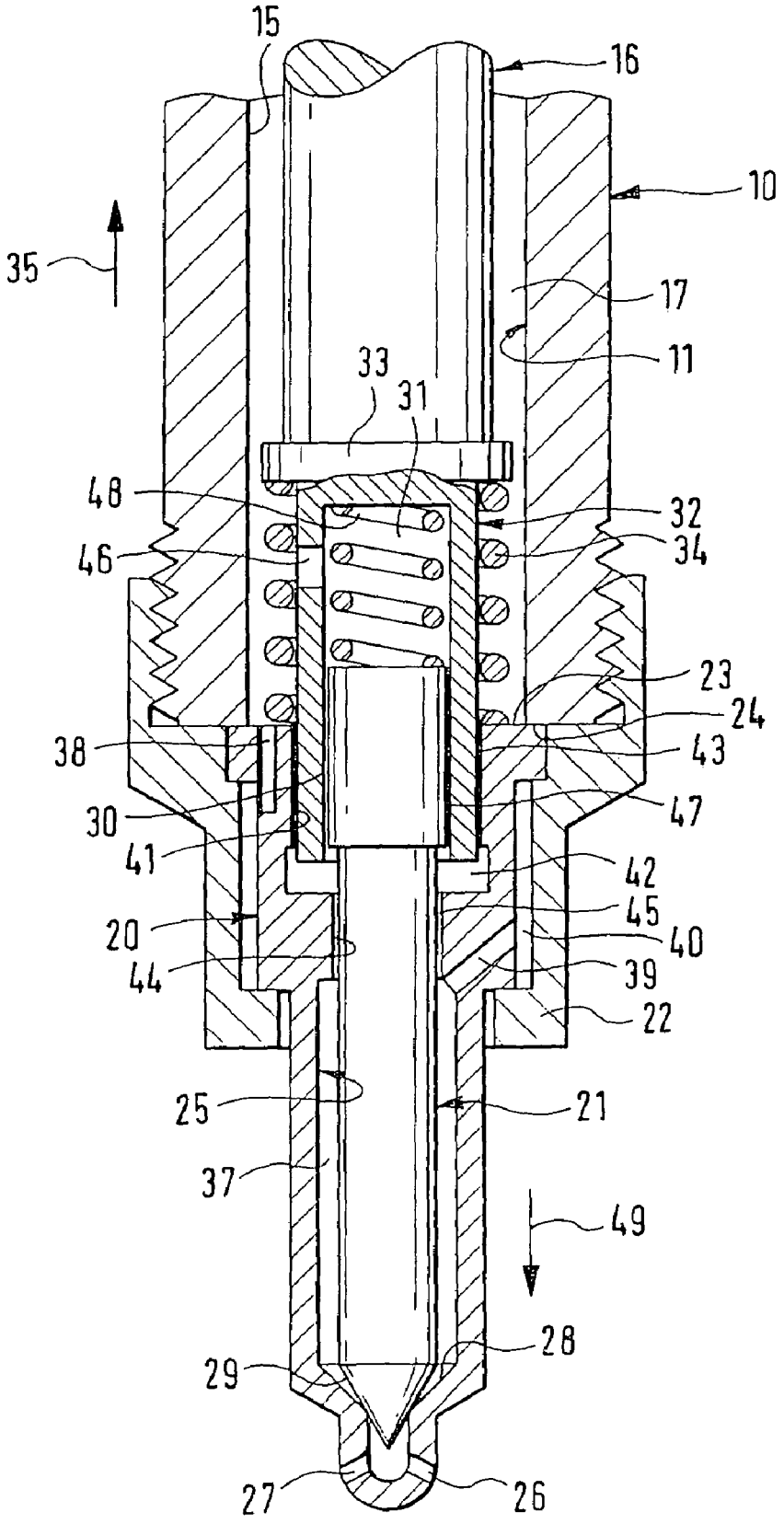

The upper (thickened) portion 30 of the nozzle needle 21 is now guided in the booster piston 32 in such a way that a (further) leakage gap 47 is created (see FIG. 2). Via this (third) leakage gap 47 as well, a hydraulic communication is established between the control chamber 42 and the annular chamber 17, subjected to high pressure, of the injector body 10.

A further special feature is that a second helical compression spring 48 is located in the inner chamber 31 of the booster piston 32 and exerts a force on the nozzle needle 21 that is oriented in the closing direction indicated by the arrow 49. Thus by means of the second compression spring 48, the nozzle needle 21 is kept closed during the intervals between injection events and when the engine is stopped. In FIGS. 1 and 2, the closed position of the nozzle needle 21 is shown. When the booster piston 32 is moved downwardly the nozzle needle 21 is raised to a position which is above that shown in the drawings. It is in this position that the injection event takes place, in which from the cylindrical pressure chamber 37, fuel passes through the outlet bores 26, 27 to reach the cylindrical combustion chamber (not shown) of the engine.

The control chamber 42 embodied on the lower end of the booster piston 32 serves the purpose of hydraulic length compensation and serves as a hydraulic booster for the elongation motion of the piezoelectric actuator 16.

The transporting of fuel from the injector body 10 to the nozzle outlet bores takes place via the (comparatively short) recess 38 (or a plurality of such recesses) through the nozzle body 20, which connects the injector body 10 with the annular chamber 40 between the clamping nut 22 and the nozzle body 20. From the annular chamber 40, the fuel is conducted through the further (comparatively short) bore 39 (or a plurality of such bores) to the nozzle outlet bores 26, 27.

The injector described above functions as follows. During the intervals between the individual injection events, there is no current supplied to the piezoelectric actuator 16. If the piezoelectric actuator 16 is then electrically triggered, it elongates and moves the booster piston 32 downward (in the direction of the arrow 49), counter to the force of the two compression springs 34, 48. In the process, the volume of the control chamber 42 is reduced, and the pressure in the control chamber 42 rises. As a result, an opening force (in the direction of the arrow 35) is exerted on the nozzle needle 21. As soon as the opening force exceeds the closing pressure forces and the force of the compression spring 48, the nozzle opens, because the nozzle needle 21 assumes the (upper) position which is above its position as seen in the drawing and thus uncovers the outlet bores 26, 27. Because of the travel boosting by means of the booster piston 32, the nozzle needle 21 can execute a maximal stroke that is markedly longer than the elongation stroke of the electrically triggered piezoelectric actuator 16.

As soon as the nozzle needle 21 has left the stroke region of the seat throttling (see FIGS. 1 and 2), a compensation of the pressure forces acting on it ensues. The piezoelectric actuator 16 must now, via the booster piston 32, keep the pressure in the control chamber 42 only far enough above the high pressure (rail pressure) prevailing at the pressure connection 18 that the resistance of the compression spring 48 is overcome.

The longest possible triggering duration is determined by the leakage (43, 45, 47) from the control chamber 42.

If the pressure in the control chamber 42 decreases to the rail pressure, then the nozzle needle 21 executes a motion downward (in the direction of the arrow 49), until with the jacket face of its conical tip 29 it closes the outlet bores 26, 27. For closing the nozzle needle 21, the electrical triggering of the piezoelectric actuator 16 is interrupted. The piezoelectric actuator 16 thereupon contracts, and the pressure in the control chamber 42 drops below the rail pressure. As a result, the nozzle needle 21 experiences the requisite closing forces, and it closes.

The compression spring 34 in the process prevents the piezoelectric actuator 16 from disconnecting from the booster piston 32. The piezoelectric actuator 16 and the booster piston 32 accordingly remain constantly in the nonpositive-engagement contact position (visible in FIGS. 1 and 2) against one another.

The foregoing relates to preferred exemplary embodiments of the invention, it being understood that other variants and embodiments thereof are possible within the spirit and scope of the invention, the latter being defined by the appended claims.

The invention claimed is:

1. In an injector for fuel injection systems of internal combustion engines, the injector having fuel, which is to be injected into the engine to be used as the engine's fuel, said fuel being supplied at an injection pressure, and a piezoelectric actuator located in an injector body and held in contact with the injector body on one side via a first spring and a sleevelike booster piston, the sleevelike booster piston having an inner chamber, a nozzle body which is joined to the injector body and having at least one nozzle outlet opening, a stepped nozzle needle guided axially displaceably in the nozzle body, the stepped nozzle needle having a back side which is spaced away from the at least one outlet opening, second spring means disposed inside the booster piston, which second spring means engages the back side of the nozzle needle, and, together with the injection pressure acting on the back side of the nozzle needle, keeps the nozzle needle in the closing position, and a control chamber embodied on the end of the booster piston which is toward the nozzle needle and which control chamber communicates, via at least one leakage gap, with said fuel that is supplied at injection pressure, the nozzle needle being urged in the opening direction by said fuel located in the control chamber, the improvement wherein the booster piston actuated by the piezoelectric actuator is spatially associated directly with the nozzle needle, in such a way that the nozzle needle is fitted, with a rear region that has a larger diameter than a region of the nozzle needle toward the nozzle outlet, into the inner chamber of the booster piston, wherein the piezoelectric actuator is centered in an axial cylindrical recess of the injector body in such a way that an annular chamber is created between the outer wall of the piezoelectric actuator and the inner wall of the cylindrical recess of the injector body, and wherein the annular chamber communicates hydraulically directly with said fuel which is supplied at injection pressure, wherein the annular chamber also extends into the region of the booster piston axially adjoining the piezoelectric actuator, and wherein the inner chamber of the booster piston communicates hydraulically with the annular chamber and thus with said fuel, and also wherein the booster piston is guided in the nozzle body, forming a leakage gap, in such a way that a hydraulic communication is created between the annular chamber that is at injection pressure and the control chamber.

2. The injector according to claim 1, wherein the nozzle body adjoins the injector body on a face end and wherein the piezoelectric actuator extends through the injector body substantially as far as the face end.

3. The injector according to claim 2, wherein the first spring comprises a compression spring concentrically surrounding the booster piston and located in the region of the annular chamber associated with the booster piston, the first spring being braced, toward the piezoelectric actuator, on a collar of the booster piston and, toward the nozzle outlet, on a rear end face of the nozzle body, in such a way that the piezoelectric actuator and the booster piston are kept in contact with one another by nonpositive engagement.

4. The injector according to claim 2, wherein the nozzle needle is guided in the inner chamber of the booster piston, forming a cylindrical leakage gap, in such a way that a hydraulic communication is created between the inner chamber of the booster piston, which is at injection pressure and the control chamber.

5. The injector according to claim 2, further comprising a cylindrical pressure chamber in the region of the nozzle body toward the nozzle outlet and surrounding the nozzle needle, the cylindrical pressure chamber communicating hydraulically with said fuel supply that is at injection pressure, and a axial recess in the nozzle body, to the rear of the cylindrical pressure chamber, in which recess the nozzle needle is guided, forming a further leakage gap, in such a way that a hydraulic communication is created between the cylindrical pressure chamber that is at injection pressure and the control chamber.

6. The injector according to claim 2, further comprising a union nut securing the nozzle body to the injector body and forming a cylindrical gap between the outer wall of the nozzle body and the inner wall of the union nut, the cylindrical gap communicating hydraulically, via recesses machined into the nozzle body, on one side with the annular chamber and on the other side with the cylindrical pressure chamber.

7. The injector according to claim 1, wherein the first spring comprises a compression spring concentrically surrounding the booster piston and located in the region of the annular chamber associated with the booster piston, the first spring being braced, toward the piezoelectric actuator, on a collar of the booster piston and, toward the nozzle outlet, on a rear end face of the nozzle body, in such a way that the piezoelectric actuator and the booster piston are kept in contact with one another by nonpositive engagement.

8. The injector according to claim 7, wherein the nozzle needle is guided in the inner chamber of the booster piston, forming a cylindrical leakage gap, in such a way that a hydraulic communication is created between the inner chamber of the booster piston, which is at injection pressure and the control chamber.

9. The injector according to claim 7, further comprising a cylindrical pressure chamber in the region of the nozzle body toward the nozzle outlet and surrounding the nozzle needle, the cylindrical pressure chamber communicating hydraulically with said fuel supply that is at injection pressure, and a axial recess in the nozzle body, to the rear of the cylindrical pressure chamber, in which recess the nozzle needle is guided, forming a further leakage gap, in such a way that a hydraulic communication is created between the cylindrical pressure chamber that is at injection pressure and the control chamber.

10. The injector according to claim 1, wherein the nozzle needle is guided in the inner chamber of the booster piston, forming a cylindrical leakage gap, in such a way that a hydraulic communication is created between the inner chamber of the booster piston, which is at injection pressure and the control chamber.

11. The injector according to claim 1, further comprising a cylindrical pressure chamber in the region of the nozzle body toward the nozzle outlet and surrounding the nozzle needle, the cylindrical pressure chamber communicating hydraulically with said fuel supply that is at injection pressure, and a axial recess in the nozzle body, to the rear of the cylindrical pressure chamber, in which recess the nozzle needle is guided, forming a further leakage gap, in such a way that a hydraulic communication is created between the cylindrical pressure chamber that is at injection pressure and the control chamber.

12. The injector according to claim 1, further comprising a union nut securing the nozzle body to the injector body and forming a cylindrical gap between the outer wall of the nozzle body and the inner wall of the union nut, the cylindrical gap communicating hydraulically, via recesses machined into the nozzle body, on one side with the annular chamber and on the other side with the cylindrical pressure chamber.

* * * * *